US006123304A

United States Patent [19]

Bateson

[11] Patent Number: 6,123,304

[45] Date of Patent: Sep. 26, 2000

[54] SWIVABLE KEYBOARD SHELF

[75] Inventor: Gary W. Bateson, Preston, Conn.

[73] Assignee: Hubbell Incorporated, Orange, Conn.

[21] Appl. No.: 08/961,241

[22] Filed: Oct. 30, 1997

[51] Int. Cl.[7] ..... E04G 3/00

[52] U.S. Cl. ..... 248/285.1; 248/349.1; 248/918

[58] Field of Search ..... 248/349.1, 285.1, 248/295.11, 297.21, 346.06, 346.03, 183.1, 118, 918–919, 240.1, 243; 312/223.3, 334.7, 334.16; 108/137, 140, 102, 103

[56] References Cited

U.S. PATENT DOCUMENTS

| | | | |
|---|---|---|---|
| 2,014,549 | 9/1935 | Behm | 108/140 |
| 2,037,919 | 4/1936 | Poe | 108/140 |
| 2,293,496 | 8/1942 | Egger | 108/140 |
| 2,332,291 | 10/1943 | Binz | 108/140 |
| 2,679,992 | 6/1954 | Schuette | 108/137 |
| 2,891,679 | 6/1959 | Maupin | 108/140 |
| 3,479,632 | 11/1969 | Galles | 248/349.1 |
| 4,305,563 | 12/1981 | Presson | 248/349 |
| 4,378,943 | 4/1983 | Newberry | 248/349.1 |
| 4,453,687 | 6/1984 | Sweere | 248/183 |
| 4,546,708 | 10/1985 | Wilburth | 248/918 X |
| 4,619,427 | 10/1986 | Leymann | 248/918 X |
| 4,648,574 | 3/1987 | Granlund | 248/349.1 |
| 4,863,124 | 9/1989 | Ball et al. | 108/28 |
| 4,909,159 | 3/1990 | Gonsoulin | 108/44 |
| 5,211,367 | 5/1993 | Musculus | 248/918 X |

*Primary Examiner*—Ramon O. Ramirez
*Assistant Examiner*—Gwendolyn Baxter
*Attorney, Agent, or Firm*—Jerry M. Presson; Joseph J. Buczynski

[57] ABSTRACT

A shelf apparatus, adaptable for supporting a computer keyboard, which is retractable into a storage compartment and can swivel and move in direction transverse to the direction of retraction, such that the orientation and position of the shelf can be changed freely when the shelf is extended out from the storage compartment. The shelf apparatus includes a shelf that is pivotally coupled to a support shelf that is retractable into the storage compartment. Alternatively, the shelf apparatus can include a shelf that is pivotally coupled to extensions which are pivotally coupled to each other and to a support inside the storage compartment. A clamp or cover is further provided which secures to the apparatus the cable which couples the computer keyboard to the computer.

23 Claims, 5 Drawing Sheets

SWIVABLE KEYBOARD SHELF

BACKGROUND OF THE INVENTION

1. Field of the Invention

The present invention relates to a shelf, adaptable for supporting a keyboard of a computer, which can swivel to orient itself and the supported computer keyboard for retraction into an opening having a reduced width. More particularly, the present invention relates to a shelf, adaptable for supporting a computer keyboard, which is retractable into a storage compartment and can swivel and move in a direction transverse to the direction of retraction, such that the orientation and position of the shelf can be changed freely when the shelf is extended out from the storage compartment.

2. Description of the Related Art

Retractable shelves, such as those used to support computer keyboards, are well known in the art. A typical retractable shelf has a surface for supporting an object, and is coupled to rails or guides which enable the shelf to be retracted into a storage compartment and extended from the storage compartment in a manner similar to that in which a desk drawer is opened and closed.

The conventional retractable computer keyboard shelves are deficient in several respects. For example, the known shelves are capable of moving along one direction only. Therefore, when the keyboard shelf is extended to allow access to the keyboard, a person attempting to use the keyboard must position himself or herself comfortably in front of the keyboard, or must awkwardly position the keyboard on the shelf. In other words, the shelf cannot be easily positioned to accommodate the location of the user.

Furthermore, the opening in the shelf storage compartment into which the shelf and keyboard is received when the shelf is retracted must be sufficient to accommodate the entire length of the keyboard, which usually is approximately 18–22 inches. Hence, the dimension of the storage compartment which extends in the direction perpendicular to that in which the shelf is retracted must also be large enough to accommodate the length of the keyboard. Such storage compartments are typically situated on top of a desk or table such that the shelf can be extended and retracted along a direction transverse to the length of the desk or table. Therefore, a large portion of the length of the surface of the desk or table is usually occupied by the compartment, and as a result, less work space is available to the person using the computer.

Additionally, known computer keyboard shelves do not include provisions to protect the cord which couples the keyboard to the computer. Hence, these cords often become damaged or tangled when the shelf is moved between the retracted and extended positions.

SUMMARY OF THE INVENTION

An object of the present invention is to provide a retractable shelf which is adaptable for supporting a computer keyboard, and which can swivel about an axis and move in a direction transverse to the direction in which it is retractable so that the shelf and keyboard can be positioned and oriented freely.

A further object of the invention is to provide a retractable shelf, adaptable for supporting a computer keyboard, and which can swivel about an axis to enable the shelf and computer keyboard to be retracted into an opening having a dimension, taken along a direction transverse to the direction of retraction, that is less than the length of the shelf and keyboard.

A further object of the invention is to provide an apparatus which is capable of protecting the cord which connects the computer keyboard to the computer from damage.

These and other objects of the present invention are achieved by providing a computer keyboard shelf, which is adaptable to support a computer keyboard, and is pivotally coupled to a supporting shelf which can move along rails, slotted members or the like, in a first direction between first and second positions with respect to, for example, a shelf storage compartment to which the rails, slotted members, and the like are coupled. The first position, for example, can be inside the storage compartment, and the second position can be outside the storage compartment.

The keyboard shelf is preferably pivotally coupled to a rail, slot or the like on the supporting shelf that extends along a second direction transverse to the first direction. The keyboard shelf is thus capable of swiveling with respect to the supporting shelf about an axis transverse to the first and second directions, and is further capable of moving along the second direction transverse to the first direction, so that the keyboard shelf and supported keyboard can be orientated and positioned freely. Also, the supporting shelf can include a raised portion which is adaptable to support the monitor of the computer.

Another embodiment of the shelf apparatus according to the present invention comprises first and second extensions which are pivotally coupled to each other. One of the extensions is pivotally coupled to a shelf supporting apparatus, such as an enclosure, storage compartment or the like, and the other extension is pivotally coupled to a shelf which is adaptable to support an object, such as a computer keyboard. The first and second extensions pivot with respect to each other and with respect to the shelf and shelf supporting apparatus to position the shelf between first and second positions, which can, for example, be inside and outside the storage compartment, respectively. Furthermore, the shelf can pivot with respect to the extension to which it is coupled to be oriented in any position about an axis transverse to the direction in which the shelf is moved between the first and second positions. Also, the opening in the storage compartment through which the shelf passes when moving between the first and second positions, can have a length smaller than the length of the shelf and keyboard, and the keyboard shelf can thus be oriented to fit into that smaller opening.

Both embodiments of the present invention can further include a clamp, fastener, or the like, for securing to the shelf the cord which couples the keyboard to the computer. Also, the second embodiment, in particular, can include a cover which is adaptable to cover the first and second extensions and the cord to thus protect the cord and extensions.

These and other objects and advantages of the invention will become more apparent and more readily appreciated from the following detailed description of the presently preferred exemplary embodiments of the invention taken in conjunction with the accompanying drawing.

BRIEF DESCRIPTION OF THE DRAWINGS

Referring now to the attached drawings which form part of the original disclosure.

DETAILED DESCRIPTION OF THE PREFERRED EMBODIMENTS

Figure 1:
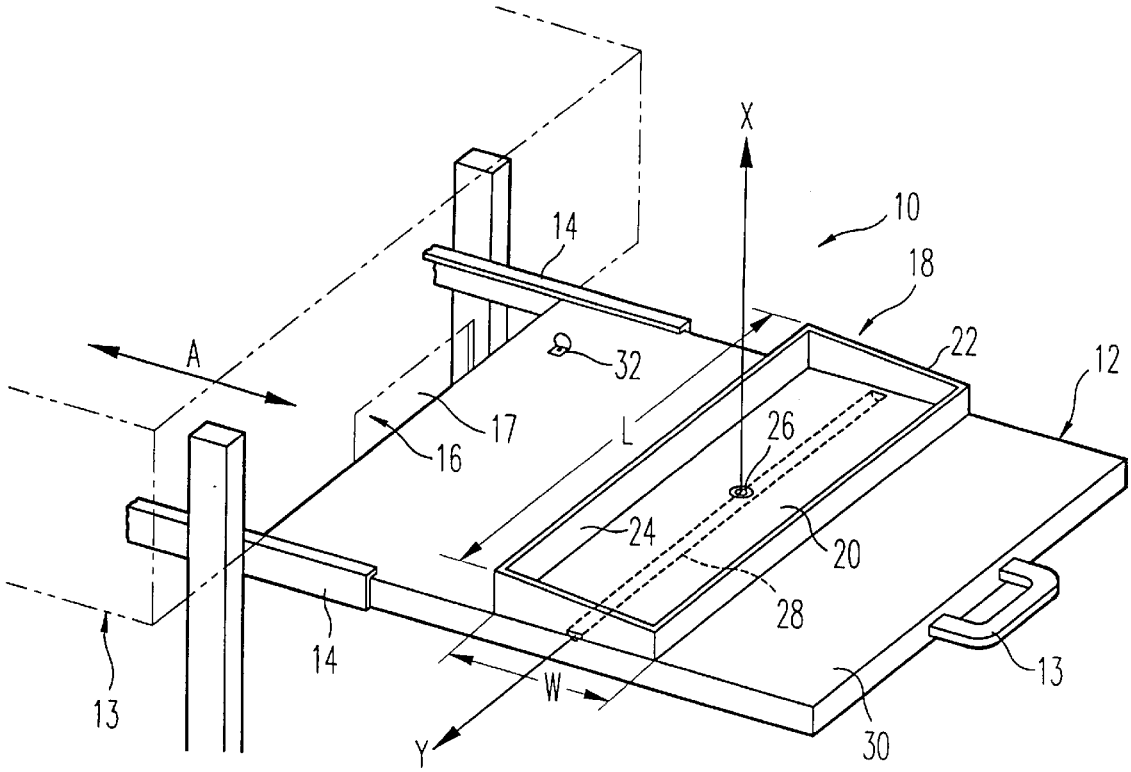
FIG. 1 is a side perspective view of an example of a swivable shelf apparatus, adaptable for supporting a computer keyboard, according to a first embodiment of the present invention.
Figure 2:
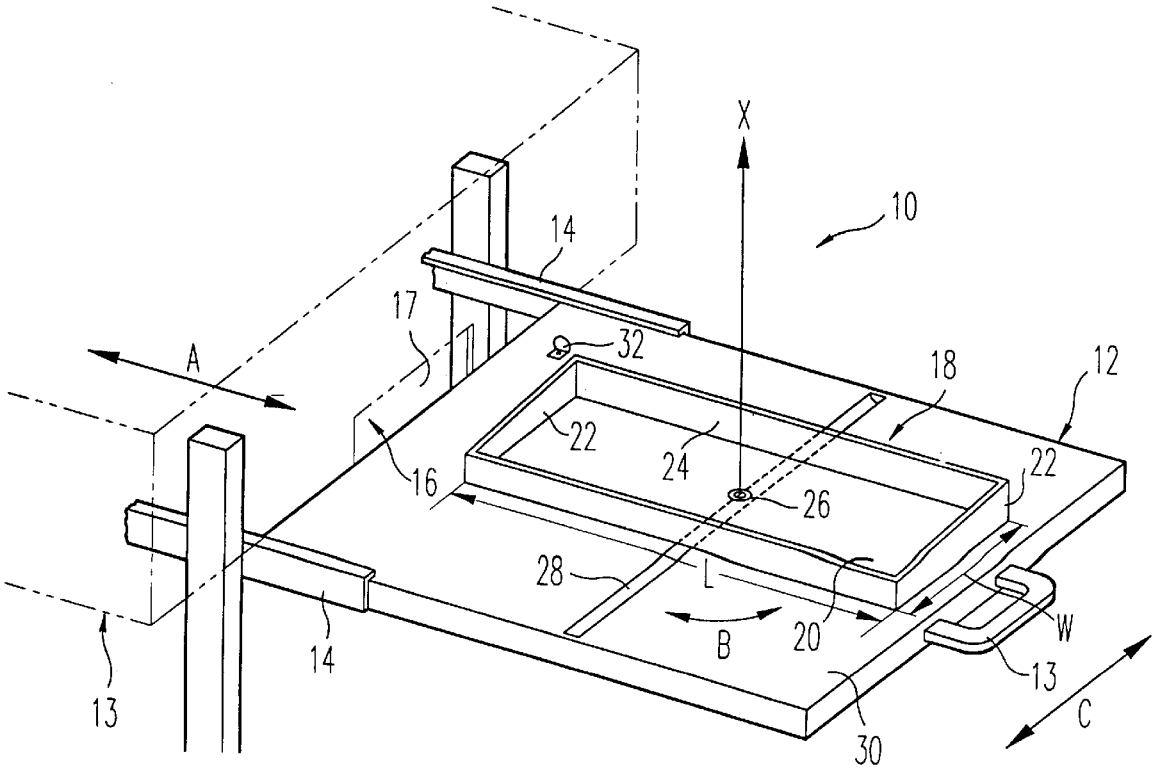
FIG. 2 is a side perspective view of the shelf apparatus shown in FIG. 1 in which the shelf that is adaptable to receive the computer keyboard is pivoted 90° about a vertical pivot axis.

An embodiment of a swivable shelf apparatus 10 according to the present invention is shown in FIGS. 1 and 2. Specifically, the apparatus 10 includes a support shelf 12 which is coupled to rails 14 that are coupled to an enclosure 13 such that the rails 14 are capable of sliding into and out of an opening 16 in the enclosure 13 in a direction along arrow A. The opening 16 can be an opening within a desk, drawer, cabinet, or the like, and the shelf 12 and rails 14 can be made of steel, aluminum, hard plastic, or any suitable material having characteristics sufficient to support, for example, a computer keyboard or the like. The support shelf 12 further includes a handle 13 which can be grasped by a user to facilitate sliding of the shelf 12 along the rails 14.

As further shown in FIG. 1, the apparatus 10 includes a pivotal shelf 18 having length L, width W and a surface 20 which is adaptable to support, for example, a computer keyboard (not shown). The pivotal shelf 18 further includes side walls 22 and a rear wall 24 which extend from the surface 20 of the shelf 18, thereby forming a three-sided enclosure into which the computer keyboard, for example, can be placed. Of course, the shelf 18 can also include a front wall opposite to rear wall 24, and the length L of the shelf 18 can be longer than the width of shelf 12.

The shelf 18 is pivotally coupled to the shelf 12 by a pivoting device or member 26, such as a pivotal ball-bearing support or any suitable type of pivotal apparatus known in the art. Specifically, as shown in FIG. 2, the shelf 12 includes a groove or rail 28 in the top surface 30 thereof. The pivotal member 26 engages with the groove 28 to pivotally couple the shelf 18 to the shelf 12. The pivotal member 26 enables the shelf 18 to pivot about an axis X with respect to the shelf 12 in the direction along arrow B. Accordingly, as shown in FIG. 2, the pivotal shelf 18 can be oriented at an angle of 90° degrees or about 90° with respect to the position in which the shelf 18 is oriented as shown in FIG. 1. Of course, the pivotal shelf 18 can be oriented at any angle about axis X as desired. Furthermore, the shelf 18 can be attached to the pivotal member by another pivotal member (not shown) so that the shelf 18 can also pivot about an axis Y normal to axis X, if desired.

Additionally, the pivotal member 26 can slide along the groove 28 in the direction illustrated by arrow C so that the shelf 18 can be positioned at any location along the width of the shelf 12. Hence, a user of the computer can orient the shelf 18 so that the computer keyboard will face in the appropriate direction in relation to the location of the user. Furthermore, the user can pull the shelf 18 towards himself or herself along groove 28 to a desired position. It is further noted that the shelf 18 can be coupled to the shelf 12 at any practical location along the surface of shelf 12. Moreover, when the shelf 18 is positioned as shown in FIG. 2, the shelf 18 and the keyboard (not shown) can slide into a recess 17 that is sufficient enough to accommodate the width W of the shelf 18 (as well as the width of the keyboard situated thereon), but is too small to accommodate the length L of the shelf 18 (and the length of the computer keyboard situated thereon).

The shelf 12 further includes a clamping apparatus 32, such as a clamp, fastener or the like, which is adaptable to clamp the cord (not shown) of the computer keyboard to the shelf 12 to safeguard the cord from being damaged when, for example, the shelf 12 is moved in the direction along arrow A in and out of the opening 16. The clamping apparatus 32 can be made of metal, plastic, or any suitable material, and is secured to the surface of the shelf 12 by a nail, screw, rivet or any suitable fastening mechanism. Alternatively, the clamping apparatus 32 can be positioned anywhere on the shelf 18, such as on the surface 20, side walls 22, or rear wall 24.

Apparatus 110

Figure 3:
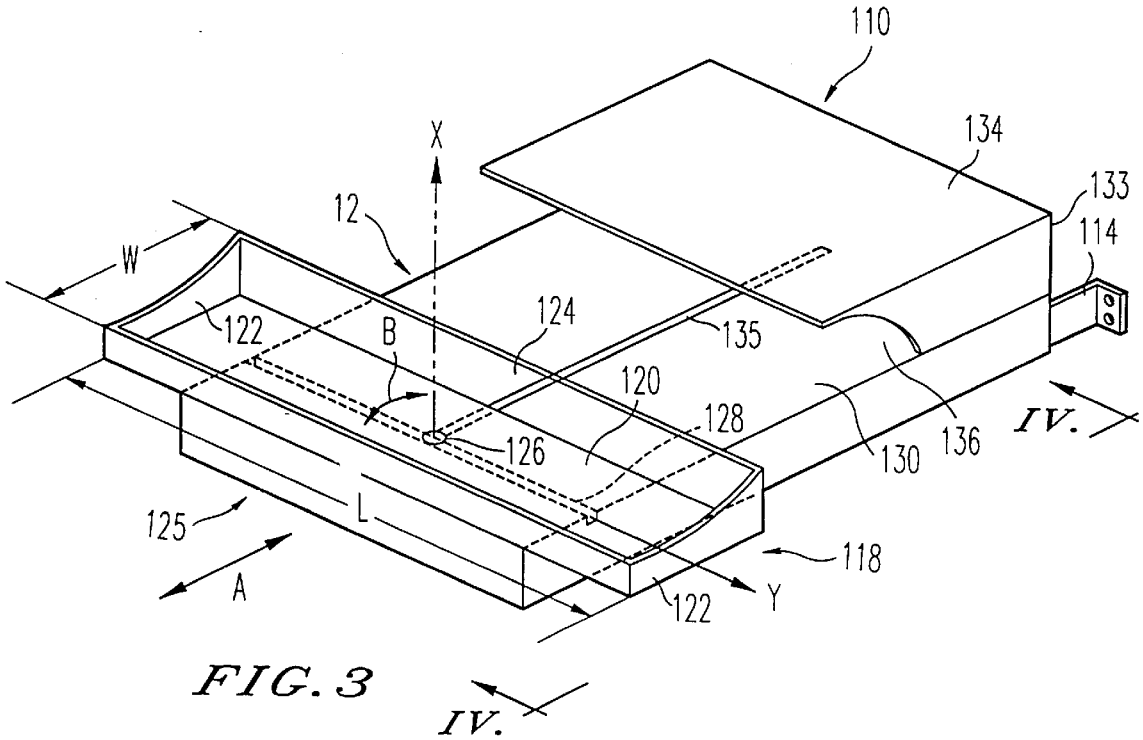
FIG. 3 is a side perspective view of a variation of the shelf apparatus shown in FIG. 1 having an upper shelf portion mounted thereto.

A modification to the apparatus 10 shown in FIGS. 1 and 2 is illustrated in FIG. 3. Specifically, the support shelf 112 of apparatus 110 shown in FIG. 3 includes an upper support shelf 133 having a surface 134 which can support, for example, a terminal of a computer (see FIG. 7). The apparatus 110 includes rails 114 which enable the shelf 112 to be moved along the direction indicated by arrow A as described above with regard to the apparatus 10 shown in FIGS. 1 and 2. Furthermore, the apparatus 110 includes a pivotal shelf 118 that is pivotally mounted to shelf 112 by a pivotal member 126 in substantially the same manner described above with regard to FIGS. 1 and 2. In this variation, the shelf 118 is shown as having a length L of about 22.5 inches, which is longer than the width of shelf 112, which is about 18 inches. The shelf has side walls 122, rear walls 124, and a front wall 125 which extend perpendicularly or substantially perpendicular from the surface 120 of the shelf 118.

Additionally, shelf 112 can have another groove or rail 135 in the top surface 130 thereof. The groove or rail 135 extends along or substantially along direction A, as indicated, and can be configured to be in communication with groove 128 so that the pivotal member 126 can move freely from groove 128 and groove 135, and viceversa. That is, the pivotal member 126 can pivotally engage groove or rail 135 from groove 128 so that the shelf 118 can slide along groove 135 with respect to the shelf 112 in a direction along or substantially along that indicated by arrow A. Hence, if desired, at least a portion of shelf 118 can be positioned under shelf 133 in recess 136.

Figure 4:
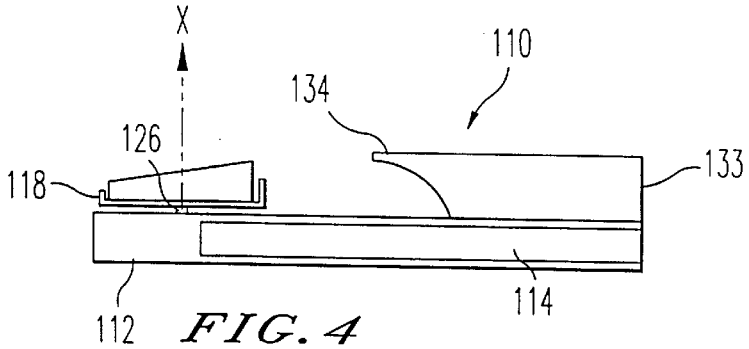
FIG. 4 is a side elevational view of the shelf apparatus shown in FIG. 3, as viewed along lines IV—IV in FIG. 3, in which the shelf is in the retracted position.
Figure 5:
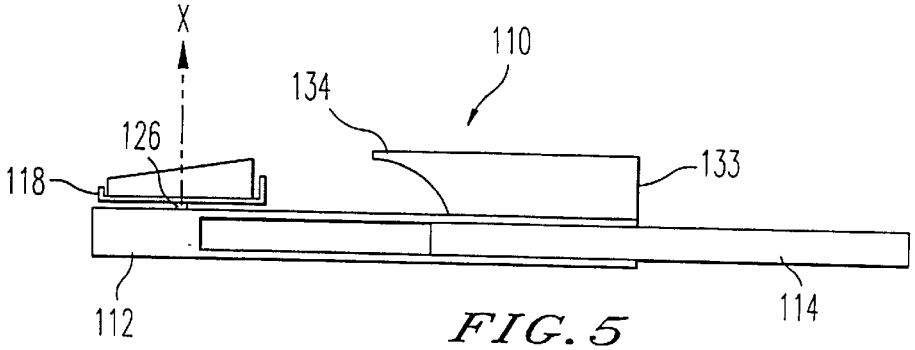
FIG. 5 is a side elevational view of the shelf apparatus as shown in FIG. 4 with the shelf in the extended position.

FIGS. 4 and 5 illustrate a side elevational view of the apparatus shown in FIG. 3 as viewed along lines IV—IV. Specifically, FIG. 4 shows the apparatus 110 with the shelf 112 positioned in the retracted position, and FIG. 5 shows the apparatus 110 with the shelf 112 in the extended position.

Figure 6:
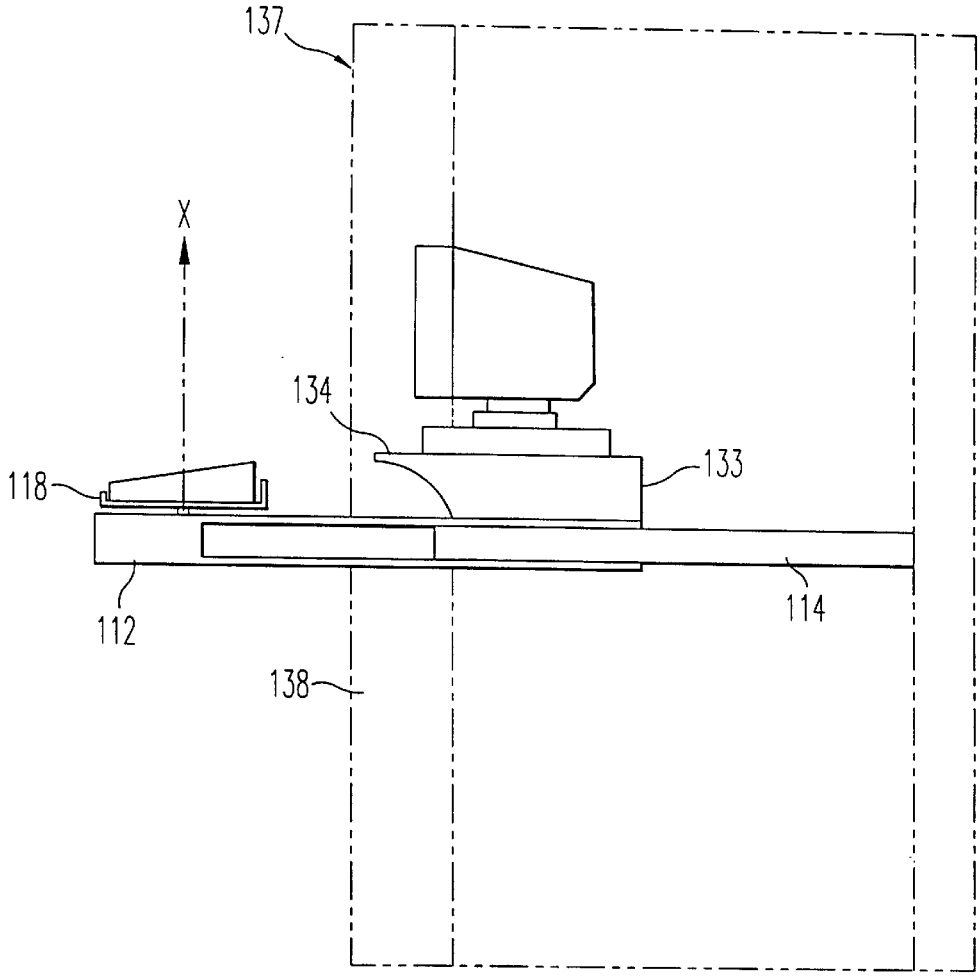
FIG. 6 is a side elevational view illustrating the shelf apparatus shown in FIGS. 3–5 as configured in a shelf storage cabinet and with the shelf being in the extended position as shown FIG. 5.

Furthermore, FIG. 6 illustrates a side elevational view of the apparatus 110 shown in FIGS. 3–5 as being mounted in a storage compartment or cabinet 137. Specifically, the rails 114 of the apparatus 110 are mounted to the inside of walls 138 of the cabinet 137 by mounting rails (not shown) or any suitable mounting structure known in the art. The apparatus 110 is configured so that the shelf 112 can be moved so that at least a portion of the shelf 112 and shelf 118 will extend out of the interior of the cabinet 137 when the shelf 112 is positioned in the extended position as indicated. The shelf 118 can pivot about the pivotal member 126 in a direction along arrow B (see FIG. 3) so that the shelf 18 can be received in an opening (not shown) smaller than that which would accommodate the length L of the shelf 118. The shelf 118 can be configured to also pivot about axis Y, if desired. Apparatus 210

Figure 7:
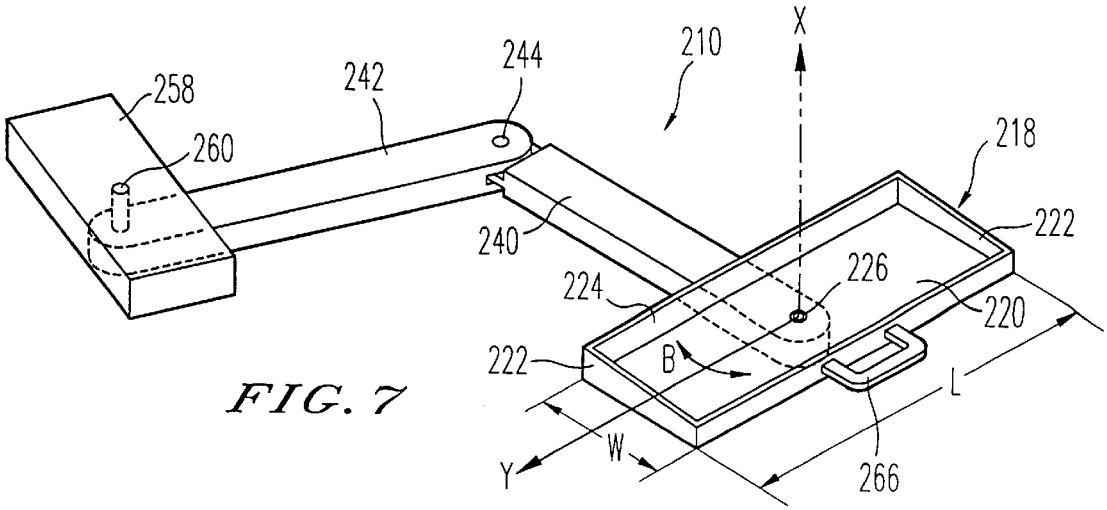
FIG. 7 is a perspective view of an example of a swivable shelf, adaptable for supporting a computer Keyboard, according to a third embodiment of the present invention.
Figure 8:
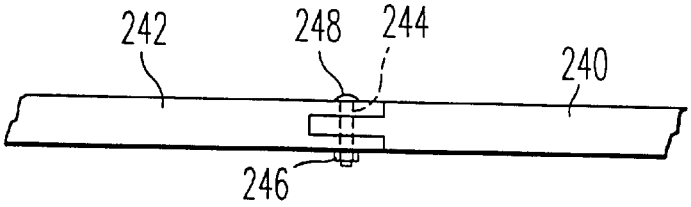
FIG. 8 is a detailed side elevational view of a coupling joint at which extensions in the swivable keyboard shelf shown in FIG. 7 are coupled together.
Figure 9:
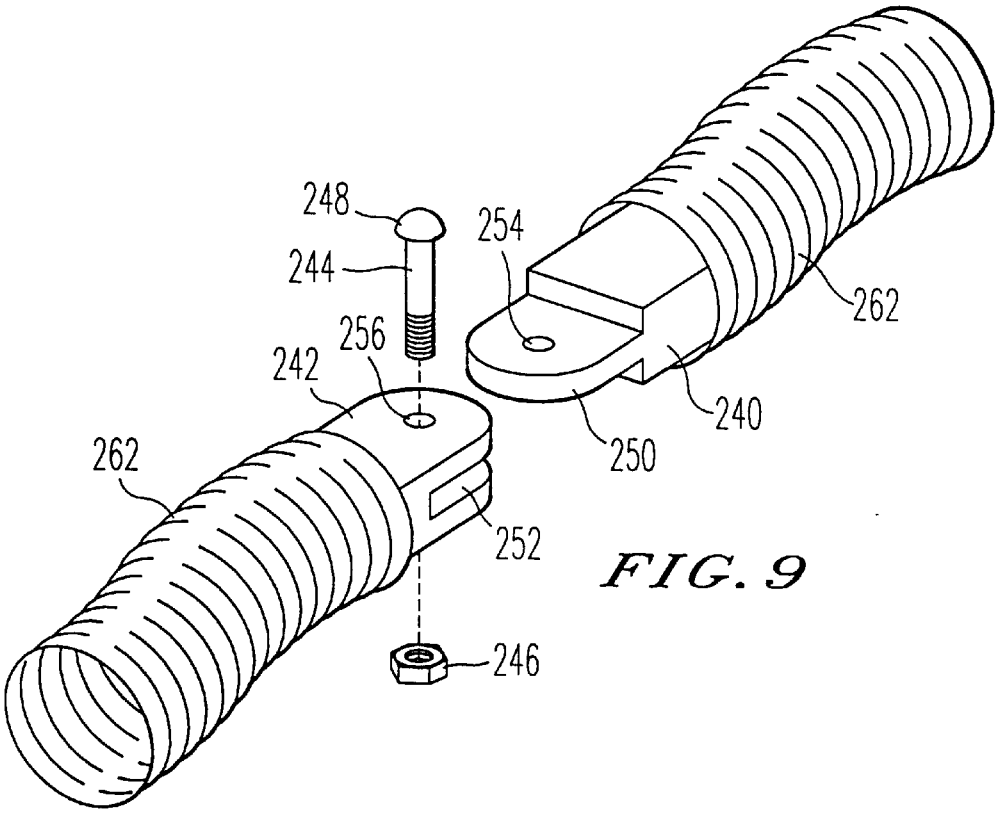
FIG. 9 is an exploded perspective view of the coupling joint shown in FIG. 8 with a cover positioned thereon.

Another embodiment of the present invention is shown in FIG. 7. In the apparatus 210 according to this embodiment, the shelf 218 is pivotally coupled to extension 240 by pivotal member 226 to pivot freely about axis X in a direction shown by arrow B. The shelf 218 has a surface 220 and side walls 222 can be configured to also pivot about axis Y, if desired. The extension 240 is pivotally coupled to another extension 242 by a pivotal coupler 244. As shown in FIGS. 8 and 9 in more detail, the pivotal coupler 244 includes a nut 246 and bolt 248 that couples a tongue and groove arrangement together. That is, the tongue portion 250 of extension 240 fits into groove portion 252 of extension 242 so that the hole 254 in tongue portion 250 aligns or substantially aligns with hole 256 in the portion of extension 242 in which the groove 252 is formed. The bolt 248 extends through holes 256 and 254 and is secured by nut 246. Of course, washers (not shown) can be inserted in the coupling arrangement as desired.

Accordingly, as shown in FIG. 8, the extensions 240 and 242 are pivotally coupled together. Naturally, the pivotal coupler 244 can be any type of pivotal coupling device know in the art. Furthermore, although this embodiment illustrates the keyboard shelf 218 as being supported by two extensions 240 and 242, if desired, the arrangement can be modified to include additional extensions that are pivotally coupled together.

As further shown in FIG. 7, the end of extension 242 opposite to that which is coupled to extension 240 is pivotally coupled to a supporting portion 258 which can be, for example, any type of support such as a desk, an inside wall of an enclosure, and so on. The extension 242 is coupled to the support 258 by pivotal coupler 260, which can be a ball-bearing type coupler, a nut and bolt arrangement, or any suitable type of pivotal device. Of course, the extensions 240 and 242 and shelf 218 can be made of any suitable materials such as hard plastic, steel, metal, wood, and so on.

Figure 10:
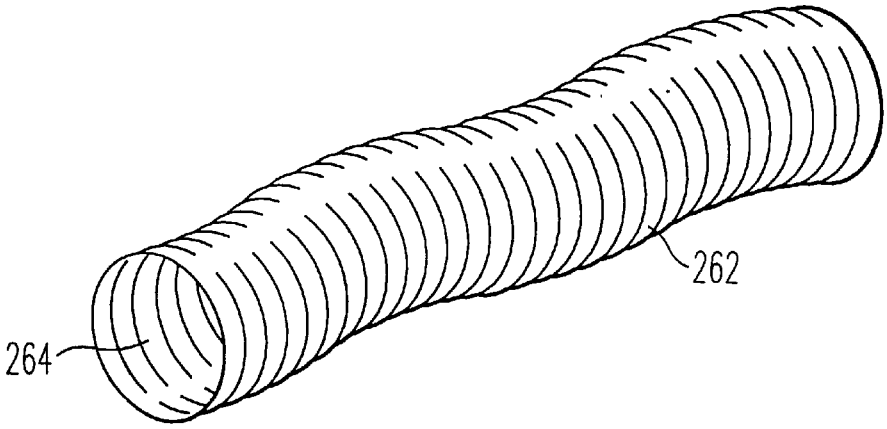
FIG. 10 illustrates the cover used in the embodiment shown in FIG. 7 according to the present invention.

Additionally, the second embodiment includes a flexible cover 262 as shown, for example, in FIG. 10. This flexible cover 262 can be made of PVC, flexible plastic, or any suitable flexible material. The cover 262 has an opening 264 throughout its entire length. Therefore, as shown in FIG. 9, the extensions 240 and 242 can be placed through opening 264 so that the cover 262 encloses the extensions 240 and 242. Of course, as shown in FIG. 9, two covers 262 can be used, or alternatively, one cover which covers extensions 240 and 242 and pivotal coupler 244 can be used. The opening 264 is also large enough so that the cable (not shown) which couples the computer keyboard to the computer can also be received therein along with extensions 240 and 242. Therefore, the cover 262 functions to protect the cable during movement of the shelf 218 and extensions 240 and 242. Also, a clamp or clamps, such as clamp 32 shown in FIG. 1, can be present on the shelf 218, extensions 240 or 242, support 258, or on any or all of these components to help secure the cable and thus protect it from potential damage. It is further noted that shelf 218 includes a handle 266 which can assist a user in manipulating the shelf 218, as now will be described with respect to FIGS. 11–13.

Figure 11:
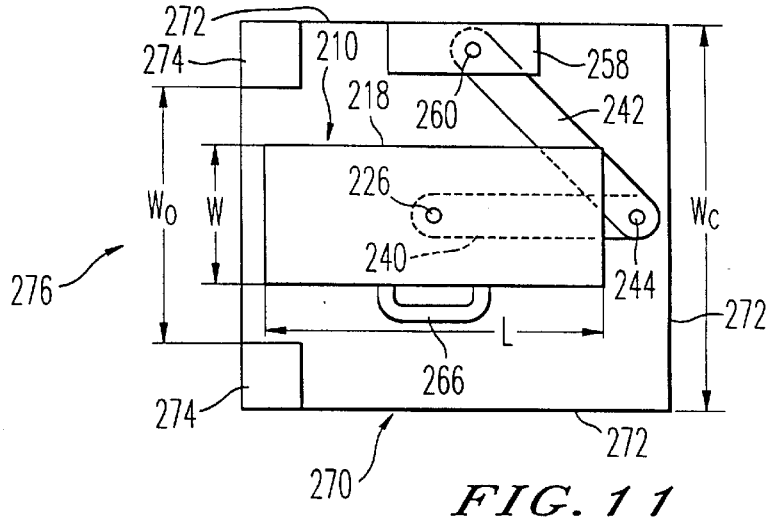
FIG. 11 is a top plan view of the swivable keyboard shelf shown in FIG. 7 as positioned inside an enclosure.

Specifically, FIG. 11 illustrates a top view of the embodiment shown in FIG. 7 as stored inside a compartment or enclosure 270. The compartment 270 can be any type of compartment, such as a compartment in a desk or cabinet, computer stand, and so on. The support 258 is securely mounted to or integral with a wall 272 of the compartment 270. Of course, the support 258 can be disposed anywhere about the inside of the compartment 270 as desired.

The compartment 270 has additional walls 274 which define an opening 276 therein. It is noted that the width Wo of opening 276 is larger than the width W of the shelf 218, but is smaller than the length L of shelf 218. This allows the overall width Wc of the compartment 270 to be smaller than if the shelf 218 were stored in an orientation as shown in FIG. 13.

Figure 12:
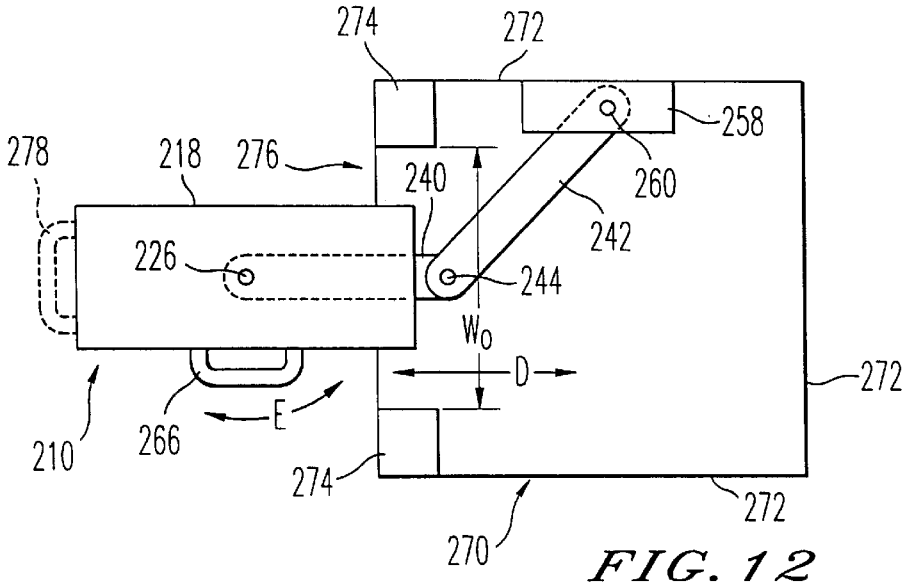
FIG. 12 is a top plan view of the swivable keyboard shelf shown in FIG. 7 as being removed from or inserted into the enclosure.

As illustrated in FIG. 12, the shelf 218 can be moved in a direction along arrow D so that the shelf 218 will pass through opening 276 in the compartment 270, and thus, extend out of the compartment 270. Specifically, when the shelf 218 is moved in the direction along arrow D, the extensions 240 and 242 will pivot with respect to each other, and extension 242 will pivot with respect to support 258. Of course, the shelf 218 can include another handle 278 to assist a user in pulling the shelf 218 along direction D out of the opening 276.

Figure 13:
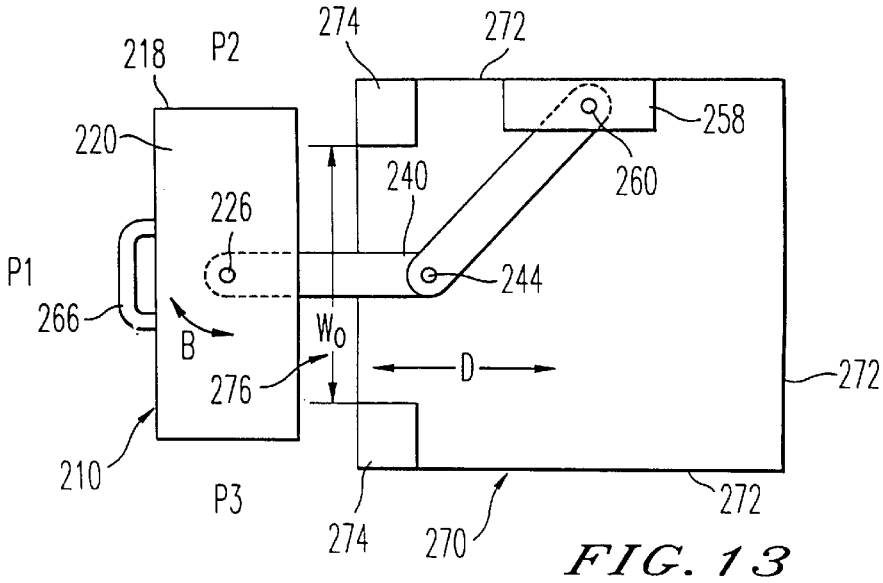
FIG. 13 is a top plan view of the swivable shelf shown in FIG. 7 positioned and oriented outside of the enclosure.

Once the apparatus 210 has been extended so that the shelf 218 is outside of the compartment 270, the shelf 218 can be pivoted with respect to extension 240 about pivotal member 226 in the direction shown by arrow B to assume a position as shown in FIG. 13. In this position, a user situated at location P1 can comfortably access the computer keyboard (not shown) situated on the surface of the shelf 218. Naturally, the shelf 218 can be moved further along direction D so that it can be extended further away from compartment 270. Also, the shelf 218 can be moved along direction D as desired while also being pivoted about direction B, so that the shelf 218 can be positioned and oriented to be comfortably used by a user situated at positions P2, P3, or at any practical position with respect to compartment 270. As in the embodiments shown in FIGS. 1–3, for example, the shelf 18 can be pivoted at any angle about axis X.

When the shelf 218 is to be stored back inside compartment 270, the shelf 218 can be reoriented along arrow B to again assume a position as shown in FIG. 12. The shelf 218 can then easily be inserted through opening 276 into the compartment 270 to assume a position as shown in FIG. 11. Accordingly, this embodiment enables the shelf 218 to be positioned and oriented freely while also enabling the overall width Wc of the enclosure 270 to be reduced.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus, adaptable for supporting a keyboard of a computer, comprising:

a shelf having a surface adapted to receive the keyboard of the computer thereon, the surface having an area which is adapted to be substantially equal to an area of a surface of the keyboard opposite to another surface of the keyboard which includes keys; and a shelf positioning apparatus coupled to the shelf to move the shelf substantially laterally along a first substantially horizontal direction between a first retracted position inside an enclosure and a second final extended position outside the enclosure while maintaining the surface substantially horizontal and restricting movement of the surface of the shelf to substantially a single horizontal plane, the shelf positioning apparatus including a pivoting device coupled between the shelf and the shelf positioning apparatus to pivot the shelf about an axis transverse to the surface of the shelf.

2. An apparatus as claimed in claim 1, wherein the shelf has a length extending along a first direction of the shelf, and a width smaller than the length and extending along a second direction of the shelf transverse of said first direction; and the pivoting device is configured to pivot the shelf about the axis to orient the shelf such that the width of the shelf extends in a direction substantially normal to the first direction.

3. An apparatus as claimed in claim 1, wherein the shelf positioning apparatus further comprises:

a rail device; and a shelf supporting device coupled to the pivoting device and to the rail device to move the shelf in the first direction.

4. An apparatus as claimed in claim 3, wherein the shelf supporting device further comprises an elevated surface having an area which is adapted to be substantially equal to a supporting surface of a monitor of the computer to support the monitor of the computer thereon.

5. An apparatus as claimed in claim 1, wherein the shelf positioning apparatus further comprises a shelf moving device coupled to the shelf to move the shelf along a second direction transverse to the first direction.

6. An apparatus as claimed in claim 1, wherein the shelf positioning apparatus further comprises first and second extensions pivotally coupled to each other by a first coupling device, the first extension further being pivotally coupled to the shelf by the pivoting device, the first extension being pivotal with respect to the second extension about the first coupling device to move the shelf between the first and second positions.

7. An apparatus as claimed in claim 6, wherein the second extension is further pivotally coupled to a shelf mounting apparatus by a second coupling device to pivot about the second coupling device which, in conjunction with the pivoting of the first extension with respect to the second extension, moves the shelf between the first and second positions.

8. An apparatus as claimed in claim 6, further comprising:

a cover which substantially encases the first and second extensions, and receives a cable of the keyboard therein.

9. An apparatus, adaptable for supporting a keyboard of a computer, comprising:

a shelf having a surface adapted to receive the keyboard of the computer thereon, the surface having an area which is adapted to be substantially equal to an area of a surface of the keyboard opposite to another surface of the keyboard which includes keys; and a shelf positioning apparatus coupled to the shelf to move the shelf substantially laterally along a first substantially horizontal direction between a first retracted position inside an enclosure and a second extended position outside the enclosure while maintaining the surface substantially horizontal, the shelf positioning apparatus including a shelf moving device coupled to the shelf to move the shelf along a second direction transverse to the first direction, and a pivoting device coupled between the shelf and the shelf positioning apparatus to pivot the shelf about an axis transverse to the surface of the shelf;

wherein the shelf moving device comprises an extending member extending in the second direction; and the pivoting device is coupled to the extending member to move along the extending member in the second direction to move the shelf in the second direction.

10. An apparatus as claimed in claim 9, wherein the extending member includes a grooved member extending in the second direction; and the pivoting device is configured to couple to the grooved member such that the pivoting device moves along the grooved member in the second direction to move the shelf in the second direction.

11. An apparatus, adaptable for supporting a keyboard of a computer, comprising:

a shelf having a surface adapted to receive the keyboard of the computer thereon, the surface having an area which is adapted to be substantially equal to an area of a surface of the keyboard opposite to another surface of the keyboard which includes keys; and a shelf positioning apparatus coupled to the shelf to move the shelf substantially laterally along a first substantially horizontal direction between a first retracted position inside an enclosure and a second extended position outside the enclosure while maintaining the surface substantially horizontal, the shelf positioning apparatus comprising a shelf moving device coupled to the shelf to move the shelf along a second direction transverse to the first direction, a pivoting device coupled between the shelf and the shelf positioning apparatus to pivot the shelf about an axis transverse to the surface of the shelf, and a second shelf moving device, the shelf selectively coupling to the second shelf moving device such that the second shelf moving device moves the shelf in a direction transverse to the second direction.

12. An apparatus, adaptable for supporting a keyboard of a computer, comprising:

a shelf having a surface adapted to receive the keyboard of the computer thereon, the surface having an area which is adapted to be substantially equal to an area of a surface of the keyboard opposite to another surface of the keyboard which includes keys; and a shelf positioning apparatus coupled to the shelf to move the shelf along a first direction between a first retracted position inside an enclosure and a final second extended position outside the enclosure while restricting movement of the surface of the shelf to substantially a single horizontal plane, the shelf positioning apparatus including:

a pivoting device coupled between the shelf and the shelf positioning apparatus to pivot the shelf about an axis transverse to the surface of the shelf; and a cable holding device configured to removably secure a cable of the keyboard thereto.

13. An apparatus adaptable to supporting a keyboard of a computer, comprising:

a shelf having a surface adapted to receive the computer keyboard thereon, the surface having an area which is adapted to be substantially equal to an area of a surface of the keyboard opposite to another surface of the keyboard which includes keys;

an enclosure having an opening therein; and a shelf positioning apparatus coupled to the shelf to move the shelf through the opening along a first substantially horizontal direction between a first retracted position inside the enclosure and a second final extended position outside the enclosure while maintaining the surface of the shelf substantially horizontal and restricting movement of the surface of the shelf to substantially a single horizontal plane.

14. An apparatus as claimed in claim 13, wherein the shelf positioning apparatus further comprises first and second extensions pivotally coupled to each other by a first coupling device, the first extension further being pivotally coupled to the shelf by the pivoting device, the first extension being pivotal with respect to the second extension about the first coupling device to move the shelf between the first and second positions.

15. An apparatus adaptable to supporting a keyboard of a computer, comprising:

a shelf having a surface adapted to receive the computer keyboard thereon, the surface having an area which is adapted to be substantially equal to an area of a surface of the keyboard opposite to another surface of the keyboard which includes keys, the shelf having a length extending along a first direction of the shelf, and a width smaller than the length and extending along a second direction of the shelf transverse of said first direction;

an enclosure having an opening therein, the opening having a length smaller than the length of the shelf; and a shelf positioning apparatus coupled to the shelf to move the shelf through the opening along a first substantially horizontal direction between a first retracted position inside the enclosure and a second extended position outside the enclosure while maintaining the surface of the shelf substantially horizontal, the shelf positioning apparatus including a pivoting device which pivots the shelf such that the width of the shelf extends in a direction transverse to the first direction so that the shelf passes through the opening when moved between the first retracted position and the second extended position.

16. An apparatus adaptable to supporting a keyboard of a computer, comprising:

a shelf having a surface adapted to receive the computer keyboard thereon, the surface having an area which is adapted to be substantially equal to an area of a surface of the keyboard opposite to another surface of the keyboard which includes keys;

an enclosure having an opening therein; and a shelf positioning apparatus coupled to the shelf to move the shelf through the opening along a first substantially horizontal direction between a first retracted position inside the enclosure and a second extended position outside the enclosure while maintaining the surface of the shelf substantially horizontal, the shelf positioning apparatus comprising a shelf moving device, coupled to the shelf to move the shelf along a second direction transverse to the first direction.

17. An apparatus as claimed in claim 16, wherein the shelf moving device comprises an extending member extending in the second direction; and the pivoting device is coupled to the extending member to move along the extending member in the second direction to move the shelf in the second direction.

18. An apparatus as claimed in claim 16, wherein the shelf positioning apparatus further comprises a second shelf moving device, the shelf selectively coupling to the second shelf moving device such that the second shelf moving device moves the shelf in a direction transverse to the second direction.

19. A method for movably supporting a keyboard of a computer, comprising the steps of:

placing a keyboard of a computer on a surface of a shelf;

moving the shelf in a substantially horizontal direction along a first direction between a first retracted position in an enclosure and a second final extended position outside the enclosure while maintaining the surface substantially horizontal and restricting movement of the surface of the shelf to substantially a single horizontal plane; and pivoting the shelf about an axis transverse to the surface of the shelf.

20. A method for movably supporting a keyboard of a computer, comprising the steps of:

placing a keyboard of a computer on a surface of a shelf, the shelf having a length extending alone a first direction of the shelf, and a width smaller than the length and extending along a second direction of the shelf transverse of said first direction;

moving the shelf in a substantially horizontal direction along a first direction between a first retracted position in an enclosure and a second extended position outside the enclosure while maintaining the surface substantially horizontal through an opening in the enclosure, the opening having a length, taken in a direction transverse to the first direction and the axis, which is smaller than the length of the shelf; and pivoting the shelf about an axis transverse to the surface of the shelf, and orienting the shelf about the axis such that the width of the shelf extends in a direction transverse to the first direction so that the shelf passes through the opening when the shelf is moved along the first direction in the moving step.

21. A method for movably supporting a keyboard of a computer, comprising the steps of:

placing a keyboard of a computer on a surface of a shelf;

moving the shelf in a substantially horizontal direction along a first direction between a first retracted position in an enclosure and a second extended position outside the enclosure while maintaining the surface substantially horizontal;

pivoting the shelf about an axis transverse to the surface of the shelf; and moving the shelf along a second direction transverse to the first direction.

22. A method as claimed in claim 21, further comprising the step of:

moving the shelf along a third direction transverse to the first direction independently of moving the shelf along the first direction.

23. A method for movably supporting a keyboard of a computer, comprising the steps of:

placing a keyboard of a computer on a surface of a shelf;

moving the shelf along a first direction between a first retracted position in an enclosure and a second final extended position outside the enclosure while restricting movement of the surface of the shelf to substantially a single horizontal plane;

pivoting the shelf about an axis transverse to the surface of the shelf; and removably securing a cable of the keyboard to the shelf.

* * * * *